US011280526B2

(12) United States Patent
Sul et al.

(10) Patent No.: US 11,280,526 B2
(45) Date of Patent: Mar. 22, 2022

(54) REFRIGERATOR

(71) Applicant: LG ELECTRONICS INC., Seoul (KR)

(72) Inventors: Heayoun Sul, Seoul (KR); Minkyu Oh, Seoul (KR); Jeehoon Choi, Seoul (KR); Hyoungkeun Lim, Seoul (KR)

(73) Assignee: LG Electronics Inc., Seoul (KR)

( * ) Notice: Subject to any disclaimer, the term of this patent is extended or adjusted under 35 U.S.C. 154(b) by 217 days.

(21) Appl. No.: 16/570,473

(22) Filed: Sep. 13, 2019

(65) Prior Publication Data

US 2020/0003462 A1 Jan. 2, 2020

Related U.S. Application Data

(63) Continuation of application No. PCT/KR2017/015742, filed on Dec. 29, 2017.

(30) Foreign Application Priority Data

Mar. 13, 2017 (KR) ..... 10-2017-0031316

(51) Int. Cl.
*F25B 21/02* (2006.01)
*F25D 15/00* (2006.01)
(Continued)

(52) U.S. Cl.
CPC ..... *F25B 21/02* (2013.01); *F25D 15/00* (2013.01); *F25D 17/062* (2013.01); *F25D 23/00* (2013.01);
(Continued)

(58) Field of Classification Search
CPC .. F25B 21/02; F25B 2321/0251; F25D 15/00; F25D 17/06; F25D 17/062;
(Continued)

(56) References Cited

U.S. PATENT DOCUMENTS 3,078,682 A 2/1963 Gould
5,522,216 A 6/1996 Park et al.
(Continued)

FOREIGN PATENT DOCUMENTS

CN 1146238 3/1997
CN 1690610 11/2005
(Continued)

OTHER PUBLICATIONS

Tomonori et al. "Cold storage for custom kitchen", Jan. 15, 2009, eSpacenet, all (Year: 2009).*
(Continued)

*Primary Examiner* — Filip Zec
(74) *Attorney, Agent, or Firm* — Fish & Richardson P.C.

(57) ABSTRACT

A refrigerator includes a cabinet, a thermoelectric element module, a support disposed at a lower surface of the cabinet, and a heat dissipation cover coupled to a rear side of the cabinet. The thermoelectric element module includes a thermoelectric element including a heat absorption portion and a heat dissipation portion, a first heat sink contacting the heat absorption portion, a first fan facing the first heat sink, a second heat sink contacting the heat dissipation portion, a second fan exposed to an outside of the heat dissipation cover, and an insulating member between the first heat sink and the second heat sink. The heat dissipation cover is configured to guide air from the second fan in a vertical direction, and the support defines an air passage between the lower surface and a floor to allow air to be discharged to a front side through a lower side of the cabinet.

20 Claims, 13 Drawing Sheets

(51) Int. Cl.

| | |
|---|---|
| ***F25D 17/06*** | (2006.01) |
| ***F25D 23/00*** | (2006.01) |
| ***F25D 23/02*** | (2006.01) |
| ***F25D 23/06*** | (2006.01) |
| ***F25D 25/02*** | (2006.01) |
| ***F25D 27/00*** | (2006.01) |

(52) U.S. Cl.
CPC ..... *F25D 23/02* (2013.01); *F25D 23/062* (2013.01); *F25D 25/025* (2013.01); *F25D 27/00* (2013.01)

(58) Field of Classification Search
CPC . F25D 2323/00264; F25D 2323/00265; F25D 2323/00274; F25D 2323/00275; F25D 23/00; F25D 23/02; F25D 23/06; F25D 23/062; F25D 23/10; F25D 25/025; F25D 27/00
See application file for complete search history.

(56) References Cited

U.S. PATENT DOCUMENTS

2003/0115892 A1* 6/2003 Fu ..... F25D 25/021 62/187
2013/0327064 A1* 12/2013 Stein ..... F25D 23/10 62/3.6
2016/0366919 A1* 12/2016 van Someren Greve ..... A23L 3/3418
2018/0281957 A1* 10/2018 Tsai ..... F28F 3/025

FOREIGN PATENT DOCUMENTS

| | | |
|---|---|---|
| CN | 202719823 | 2/2013 |
| FR | 1347414 | 12/1963 |
| JP | H07218095 | 8/1995 |
| JP | H09313270 | 12/1997 |
| JP | 2000205736 | 7/2000 |
| JP | 2006153336 | 6/2006 |
| JP | 2009008359 | 1/2009 |
| KR | 100569935 | 4/2006 |

OTHER PUBLICATIONS

Chinese Office Action in Chinese Application No. 201780088361.8, dated Sep. 30, 2020, 16 pages (with English translation).
Extended European Search Report in European Application No. 17900695.2, dated Dec. 4, 2020, 8 pages.

* cited by examiner

REFRIGERATOR

CROSS-REFERENCE TO RELATED APPLICATIONS

This application is a continuation of International Application No. PCT/KR2017/015742, filed on Dec. 29, 2017, which claims the benefit of Korean Application No. 10-2017-0031316, filed on Mar. 13, 2017. The disclosures of the prior applications are incorporated by reference in their entirety.

TECHNICAL FIELD

The present disclosure relates to a refrigerator having a thermoelectric element module and exhibiting high refrigeration performance with low noise.

BACKGROUND

A thermoelectric element includes a device that implements heat absorption and heat generation using a Peltier effect. The Peltier effect refers to an effect occurring when a voltage applied to both ends of a device causes an endothermic phenomenon on one side and an exothermic phenomenon on the other side depending on a direction of a current. In some cases, the thermoelectric element may be used in a refrigerator instead of a refrigerating cycle device.

A refrigerator may have a food storage space capable of blocking heat penetrating from an outside by a cabinet filled with an insulating material and a door. In some examples, the refrigerator may include a refrigerating device including an evaporator for absorbing heat inside of the food storage space and a heat dissipating device for dissipating collected heat to an outside of the food storage space to thereby maintain the food storage space as a low temperature region, where microorganisms cannot survive or proliferate, and to keep stored food for a long period of time without spoiling it.

The refrigerator may be divided into a refrigerating chamber for storing food in a temperature region above zero and a freezing chamber for storing food in a temperature region below zero. In some cases, the refrigerator may be classified into a top freezer refrigerator including an upper freezing chamber and a lower refrigerating chamber, a bottom freezer refrigerator having a lower freezing chamber and an upper refrigerating chamber, and a side by side refrigerator having a left freezing chamber and a right refrigerating chamber depending on an arrangement of the refrigerating chamber and the freezing chamber.

The refrigerator may include a plurality of shelves, drawers, and the like, in the food storage space so that a user may conveniently store or take out food stored in the food storage space.

A built-in refrigerator may be embedded in furniture or walls when a building is built. For examples, the built-in refrigerators may be embedded in furniture, walls, and the like while other refrigerators may be installed in an open space. In some cases, the built-in refrigerators may be more vulnerable to heat than other refrigerators.

In a heat dissipation structure of a built-in refrigerator, air may be suctioned through a bottom surface of the refrigerator in the machine room and the air may be discharged to the rear of the refrigerator. Air discharged to the rear of the refrigerator may rise by natural convection.

In some cases, where the machine room is installed at a lower end of the refrigerator, hot air discharged to the rear of the refrigerator may affect the entire rear surface of the refrigerator. This is because the air rising by natural convection passes the entire area of the rear surface of the refrigerator. This may adversely affect an insulation load and performance of the refrigerator.

In some cases, the air discharged to the rear of the refrigerator may not rise, but be re-suctioned into the machine room. For example, when the left and right sides of the refrigerator are shielded like a built-in refrigerator, hot air may be re-suctioned into the machine room.

In some cases, the built-in refrigerator may be smaller in size than a general refrigerator, and hot air discharged to the rear of the refrigerator may be directed to a user's face along an upper surface of the built-in refrigerator.

In some cases, a ventilation hole may be defined at a machine room to allow air to flow through the ventilation hole and to be discharged through a machine room. In this case, air discharged through the machine room may rise due to natural convection and further accelerate re-suction of the air through the ventilation hole to the inside of the refrigerator.

SUMMARY

The present disclosure may provide a refrigerator having a structure in which a storage chamber is cooled by a thermoelectric element module and a heat dissipation flow may be facilitated by a fan provided in the thermoelectric element module. In particular, the present disclosure is to provide a heat dissipation structure suitable for a built-in refrigerator.

The present disclosure may also provide a refrigerator having a structure in which an inlet and an outlet of air for heat dissipation are disposed to be away from each other so that hot air discharged from the refrigerator may be prevented from being suctioned back into the refrigerator.

In the present disclosure, air may be discharged for heat dissipation in a direction other than toward the user's face.

The present disclosure may also provide a refrigerator having a structure in which an audio-visual module is installed together in the heat dissipation structure to provide visual and auditory sensation to a user without being exposed to the outside.

According to one aspect of the subject matter described in this application, a refrigerator includes: a cabinet including an inner case that defines a storage chamber, an outer case that covers the inner case, and an insulating material disposed between the inner case and the outer case; a thermoelectric element module disposed at a rear wall of the cabinet facing the storage chamber and configured to cool the storage chamber; a support disposed at a lower surface of the cabinet and configured to support the cabinet; and a heat dissipation cover coupled to a rear side of the outer case. The thermoelectric element module includes: a thermoelectric element including a heat absorption portion and a heat dissipation portion that face opposite directions; a first heat sink that is in contact with the heat absorption portion and that is configured to exchange heat with the storage chamber; a first fan that faces the first heat sink and that is configured to generate air flow to thereby assist heat exchange of the first heat sink; a second heat sink that is in contact with the heat dissipation portion and that is configured to exchange heat with an external region of the outer case; a second fan that is exposed to an outside of the heat dissipation cover, that faces the second heat sink, and that is configured to draw air from an outside of the heat dissipation cover to an inner side of the heat dissipation cover to thereby assist heat exchange of the second heat sink; and an insulating member that surrounds an edge of the thermoelectric element and that is disposed between the first heat sink and the second heat sink. The heat dissipation cover is configured to guide air from the second fan in a vertical direction, and the support defines an air passage between the lower surface of the cabinet and a floor to allow air passing through the second fan to be discharged to a front side of the cabinet through a lower side of the cabinet.

Implementations according to this aspect may include one or more of the following features. For examples, the second fan may be disposed vertically above a center of the heat dissipation cover and configured to draw air through an upper portion of the heat dissipation cover. In some implementations, the heat dissipation cover may include a main plate that is spaced apart from a rear surface of the outer case and that defines a flow path configured to guide flow of air with the rear surface of the outer case, and an edge portion that protrudes from an edge of the main plate toward the outer case and that is coupled to the outer case.

In some implementations, the main plate may define a cover opening that faces the second fan, and the second fan may be exposed to the outside of the heat dissipation cover through the cover opening. In some examples, the main plate may include an inclined portion that is disposed at a periphery of the cover opening and that is inclined with respect to the rear surface of the outer case. In these examples, a horizontal distance between the rear surface of the outer case and the inclined portion increases from an outer edge of the inclined portion toward the periphery of the cover opening. In some examples, the heat dissipation cover may further define at least one ventilation hole arranged around the cover opening.

In some implementations, the heat dissipation cover may include: a first guide portion that protrudes from the main plate toward the outer case, that extends downward from the cover opening in the vertical direction, and that is configured to guide air downward from the second fan in the vertical direction; and a second guide portion that protrudes forward from a lower end of the first guide portion to a position between the cabinet and the floor, the second guide portion being configured to guide air from the first guide portion to the front side of the cabinet through the lower side of the cabinet.

In some implementations, the second heat sink may include: a base that is in surface contact with the thermoelectric element; and a plurality of fins that protrude from the base toward the second fan and that are spaced apart from one another in a horizontal direction. The plurality of fins may extend in the vertical direction and be configured to guide air downward from the second fan in the vertical direction toward the lower side of the cabinet.

In some examples, the second fan may include an axial flow fan configured to generate wind along an axial direction toward the front side of the cabinet. The refrigerator may include a left surface, a right surface, and a rear surface that are covered by a shielding film. The refrigerator may further include a stopper that protrudes rearward from the heat dissipation cover and defines a space between the heat dissipation cover and the shielding film disposed at the rear surface of the refrigerator. In some examples, the heat dissipation cover may have an accommodation portion configured to accommodate the stopper, where the stopper is configured to be inserted into the accommodation portion or be drawn out from the accommodation portion by a rotational movement or a linear movement relative to the heat dissipation cover.

In some implementations, the second fan may include an axial flow fan configured to generate wind along an axial direction toward the front side of the cabinet. The refrigerator may include a left surface, a right surface and a rear surface that are covered by a shielding film. The heat dissipation cover may include: a main plate that is spaced apart from a rear surface of the outer case and that defines a flow path configured to guide flow of air with the rear surface of the outer case; and an edge portion that protrudes from an edge of the main plate toward the cabinet and that is coupled to the cabinet. The main plate may include: a first portion that defines a cover opening that faces the second fan, and a second portion that is disposed at one side of the first portion, that protrudes rearward of the first portion, and that defines a space between the first portion and the shielding film disposed at the rear surface of the refrigerator.

In some implementations, the support may include: a bridge portion that separates the cabinet from the floor and that supports the cabinet, the bridge portion defining a discharge port configured to discharge air from the lower side of the cabinet to the front side of the cabinet; and a rib connected to a plurality of portions of the bridge portion and configured to reinforce strength of the support.

In some implementations, the lower surface of the cabinet may include a front portion, a rear portion, and a middle portion disposed between the front portion and the rear portion, where the support supports the middle portion and the rear portion of the lower surface of the cabinet, and the front portion of the lower surface of the cabinet is spaced apart from the floor.

In some implementations, the refrigerator may further include an audio-visual module disposed at a front surface of the support and configured to output at least one of light or sound. In some examples, the support may define a discharge port configured to discharge air from the lower side of the cabinet toward the front side of the cabinet, and the discharge port is defined at least at one side of the audio-visual module.

In some implementations, the discharge port may include: a main discharge port defined at both sides of the audio-visual module; and a sub-discharge port defined at a position vertically below the audio-visual module, where a size of the sub-discharge port is less than a size of the main discharge port.

In some examples, the audio-visual module may include two audio-visual modules spaced apart from each other, and the discharge port may include: a main discharge port defined between the two audio-visual modules; and a sub-discharge port defined at a position vertically above or below the two audio-visual modules, where a size of the sub-discharge port being is than a size of the main discharge port.

In some implementations, a capacity of the storage chamber may be less than or equal to 200 liter. In some examples, the refrigerator may further include a drawer configured to be inserted into and withdrawn from the storage chamber through the front side of the cabinet. In some examples, the bridge portion of the support may be disposed between the front side of the cabinet and a rear end of the drawer based on the drawer being inserted into the storage chamber.

In some implementations, air flowing continuously at the upper side of the refrigerator and the rear side of the refrigerator may be introduced into the heat dissipation cover through the heat dissipation cover disposed behind the cabinet. The air introduced into the inside of the heat dissipation cover cools the second heat sink. Air is then guided by the heat dissipation cover and flows in the top-down direction and may be discharged to the front of the cabinet through a lower side of the cabinet. The fins of the second heat sink as well as the heat dissipation cover are arranged to guide air in the top-down direction, so that a flow direction of the air may be set in one direction.

In some examples, air may be drawn by the second fan. A cover opening, where the second fan is installed, may be function as a suction port and a lower side of the cabinet may be function as a discharge port. The suction port and the discharge port may be spaced apart from each other in a vertical direction and also in a horizontal direction. This spacing structure may prevent air discharged through the lower side of the cabinet from being suctioned back to the inside of the heat dissipation cover.

Considering that the refrigerator is mainly installed on the floor, air may be discharged to the lower side of the cabinet and not directed to the user's face may be obtained.

In some implementations, an audio-visual module may be installed on a support that is a component of a heat dissipation structure for allowing air to be discharged forward. The audio-visual module may provide the user with a visual and auditory sense, and may be not visually exposed to the user.

The heat dissipation structure may be suitable for a built-in refrigerator. In some examples, the heat dissipation structure may include a ventilation hole, and also be utilized in a general refrigerator other than the built-in structure.

DETAILED DESCRIPTION

Figure 1:
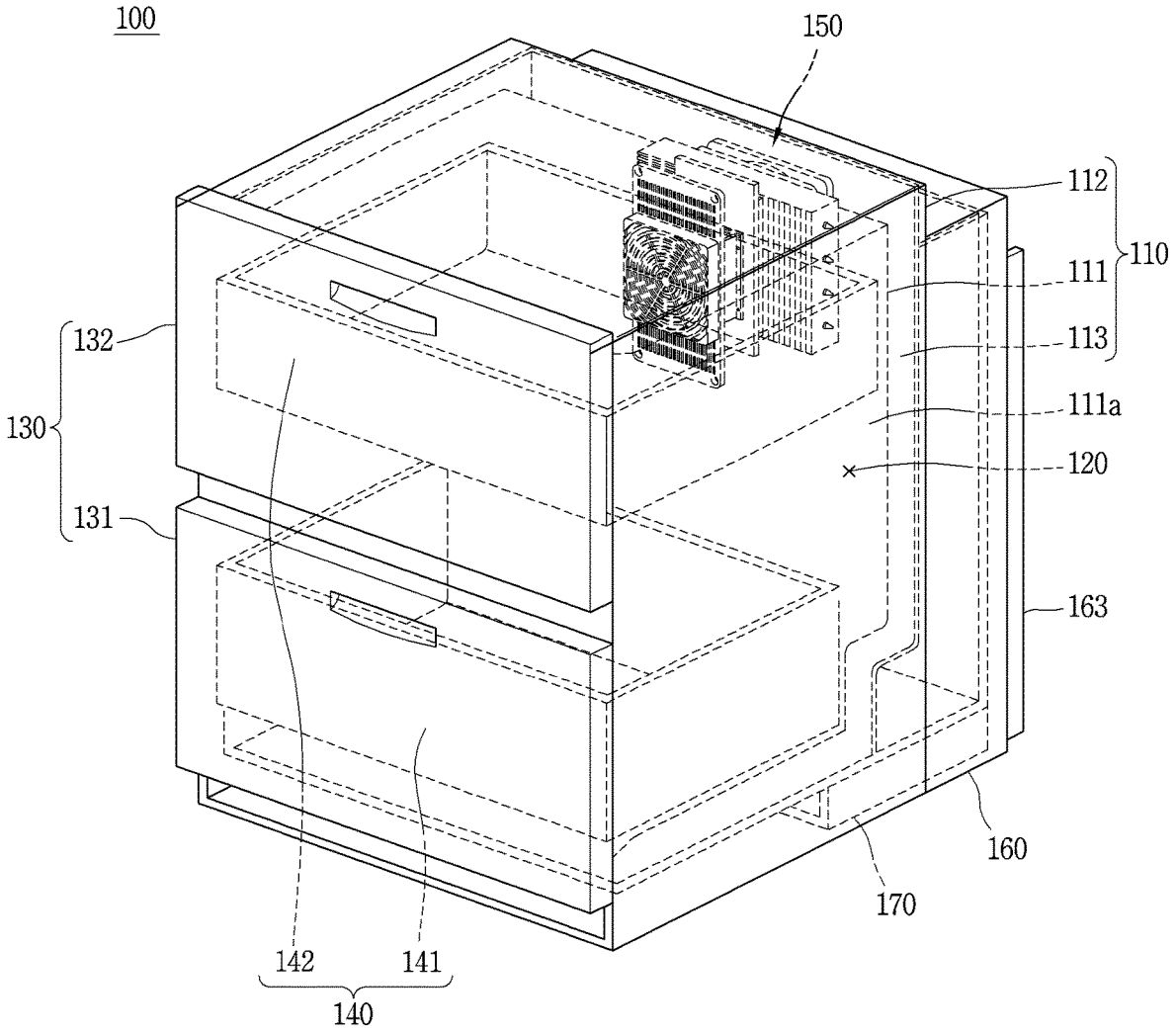
FIG. 1 is a conceptual view illustrating an example of a refrigerator including a thermoelectric element module.

Hereinafter, a refrigerator according to the present disclosure will be described in detail with reference to the drawings. In the present specification, the same reference numerals are given to the same components in different implementations, and the description thereof is replaced with the first explanation. As used herein, the singular forms "a", "an" and "the" include plural referents unless the context clearly dictates otherwise.

FIG. 1 is a conceptual view illustrating an example of a refrigerator having a thermoelectric element module.

A refrigerator 100 may be configured to simultaneously perform functions of a small side table and a refrigerator 100. For example, the small side table may be a small table by a bed or on a side of a kitchen. The small side table may allow a desk lamp or the like to be placed on an upper surface thereof and allow a small stuff to be received therein. The refrigerator 100 may be capable of storing food and the like at low temperatures while maintaining the original function of the small side table, which allows a desk lamp or the like to be placed thereon.

The cabinet 110 may include an inner case 111, an outer case 112, and an insulating material 113.

The inner case 111 is provided inside the outer case 112 and forms a storage chamber 120 capable of storing food at a low temperature. The size of the storage chamber 120 formed by the inner case 111 should be limited to about 200 L or less because the size of the refrigerator 100 is limited in order for the refrigerator 100 to be used as a small table.

The outer case 112 may surround at least a portion of the inner case 111, and define an outer appearance of a small table shape. The outer case 112 may define an appearance of upper and lower surfaces and left and right side surfaces of the refrigerator 100. In some examples, the front surface of the refrigerator 100 may include a door 130, and the rear surface may include a heat dissipation cover to be described later. In some examples, an upper surface of the outer case 112 may be flat to allow a small item such as a desk lamp to be placed thereon.

The insulating material 113 is disposed between the inner case 111 and the outer case 112. In some examples, the insulating material 113 may be made of polyurethane foam. The insulating material 113 is configured to suppress transfer of heat from a relatively hot outside to the relatively cold storage chamber 120.

The door 130 is mounted on a front portion of the cabinet 110. The door 130 forms an appearance of the refrigerator 100 together with the cabinet 110. The door 130 is configured to open and close the storage chamber 120 by a sliding movement. The door 130 may include two or more doors 131 and 132 in the refrigerator 100 and the doors 131 and 132 may be disposed along the vertical direction as shown in FIG. 1.

In some implementations, the storage chamber 120 may include a drawer 140 for efficiently utilizing the space. The drawer 140 forms a food storage area in the storage chamber 120. The drawer 140 is coupled to the door 130 and is formed to be able to be drawn out from the storage chamber 120 according to the sliding movement of the door 130.

Two drawers 141 and 142 may be arranged along the vertical direction like the door 130. One drawer 141 is coupled to one door 131 and another drawer 142 is coupled to another door 132. The drawers 141 and 142 coupled to the doors 131 and 132 may be drawn out from the storage chamber 120 along the doors 131 and 132 each time the doors 131 and 132 slide.

The refrigerator 100 operates 24 hours a day, unlike other home appliances at home. Thus, if the refrigerator 100 is placed next to a bed, noise and vibration in the refrigerator 100, especially at night, are transmitted to a person sleeping in the bed to interfere with sleep. In particular, noise and vibration generated in a refrigerator implemented in a building or furniture, such as a built-in refrigerator, is likely to be transmitted to a person along a wall or furniture. Therefore, in order for the refrigerator 100 to be disposed beside the bed to simultaneously perform the function of the side table and the refrigerator 100, low noise and low vibration performance of the refrigerator 100 may be sufficiently secured.

If a refrigeration cycle device including a compressor is used for cooling the storage chamber 120 of the refrigerator 100, it is difficult to block noise and vibration generated in the compressor. Therefore, in order to secure low noise and low vibration performance, the refrigeration cycle device should be used only limitedly, and the refrigerator 100 of the present disclosure cools the storage chamber 120 using the thermoelectric element module 150.

The thermoelectric element module 150 is installed on the rear wall 111*a* of the storage chamber 120 to cool the storage chamber 120. The thermoelectric element module 150 includes a thermoelectric element, and the thermoelectric element refers to an element that implements cooling and heat generation using a Peltier effect. When the heat absorption side of the thermoelectric element is disposed to face the storage chamber 120 and a heat generation side of the thermoelectric element is disposed toward the outside of the refrigerator 100, the storage chamber 120 may be cooled through an operation of the thermoelectric element.

In order to sufficiently perform cooling on the heat absorption side of the thermoelectric element, heating should be smoothly performed on the heat generation side. If a temperature difference between the heat absorption side and the heat generation side is constant, as a temperature on the heat generation side is lower, a temperature on the heat absorption side is lowered. The present disclosure proposes the refrigerator 100 including the heat dissipation cover 160 and a support 170 for smooth heat dissipation of the heat generation side.

The heat dissipation cover 160 is coupled to the rear of the outer case 112. The heat dissipation cover 160 may be provided with a stopper 163. The support 170 is installed on a bottom surface of the cabinet 110 to support the cabinet 110.

A detailed structure of the heat dissipation cover 160 and the support 170 will be described later.

If a cooler for cooling the storage chamber 120 is implemented as a refrigeration cycle device including a compressor, a condenser, an expander, an evaporator, etc., it is difficult to fundamentally block vibration and noise generated in the compressor. Especially in recent years, an installation place of a refrigerator such as a cosmetic refrigerator is not limited to a kitchen but is extended to a living room or a bedroom. If noise and vibration are not fundamentally blocked, it may cause significant inconvenience for a user of the refrigerator.

If the thermoelectric element is applied to the refrigerator 100, the storage chamber may be cooled without a refrigeration cycle device. In particular, the thermoelectric element does not generate noise and vibration unlike a compressor. Therefore, if the thermoelectric element is applied to the refrigerator 100, the problem of noise and vibration may be solved even though a refrigerator is installed in a space other than the kitchen.

Since the thermoelectric element has a size smaller than the refrigeration cycle device, the refrigerator 100 employing the thermoelectric element may be smaller than a refrigerator having the refrigeration cycle device. Therefore, the thermoelectric element is advantageous for the built-in refrigerator 100 than the refrigeration cycle device.

Figure 2:
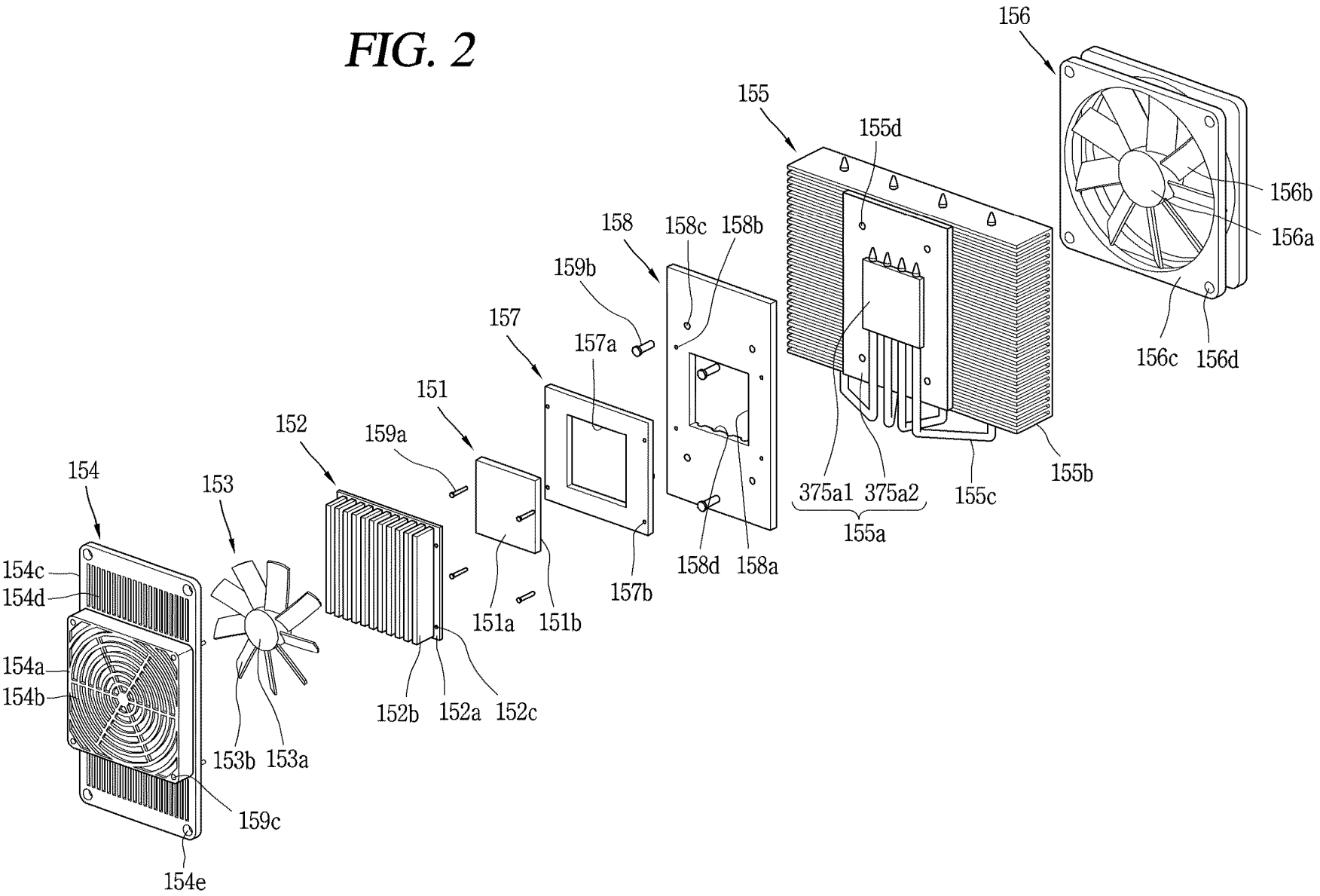
FIG. 2 is an exploded perspective view of an example of a thermoelectric element module.

FIG. 2 is an exploded perspective view of an example of the thermoelectric element module 150.

The thermoelectric element module 150 includes a thermoelectric element 151, a first heat sink 152, a first fan 153, a second heat sink 155, a second fan 156, and an insulating member 157. The thermoelectric element module 150 operates between a first region and a second region that are distinguished from each other, and absorb heat in one region and dissipate heat in another region.

The first region and the second region indicate regions that are spatially distinguished from each other by a boundary. If the thermoelectric element module 150 is applied to the refrigerator 100 of FIG. 1, the first region corresponds to one of the storage chamber and the outside of the refrigerator and the second region corresponds to the other.

The thermoelectric element 151 has a PN junction with a P-type semiconductor and an N-type semiconductor and may be formed by connecting a plurality of PN junctions in series.

The thermoelectric element 151 has a heat absorption portion 151*a* and a heat dissipation portion 151*b* facing in opposite directions. In some implementations, the heat absorption portion 151*a* and the heat dissipation portion 151*b* are formed in a surface contactable manner for effective heat transfer. Therefore, the heat absorption portion 151*a* may be referred to as a heat absorption surface, and the heat dissipation portion 151*b* may be referred to as a heat dissipation surface. Further, the heat absorption portion 151*a* and the heat dissipation portion 151*b* may be generalized and named as a first portion and a second portion or a first surface and a second surface. Such nomenclature is for convenience of description only and does not limit the scope of the disclosure.

The first heat sink 152 is disposed in contact with the heat absorption portion 151*a* of the thermoelectric element 151. The first heat sink 152 is configured to exchange heat with the first region. The first region corresponds to the storage chamber 120 in FIG. 1 of the refrigerator, and an object to be heat-exchanged by the first heat sink 152 is air inside the storage chamber.

The first fan 153 is installed to face the first heat sink 152 and generates wind to accelerate the heat exchange of the first heat sink 152. Since heat exchange is a natural phenomenon, the first heat sink 152 may exchange heat with the air in the storage chamber even without the first fan 153. However, as the thermoelectric element module 150 includes the first fan 153, the heat exchange of the first heat sink 152 may be further accelerated.

The first fan 153 may be covered by a cover 154. The cover 154 may include a portion other than a portion 154*a* covering the first fan 153. A plurality of holes 154*b* may be formed in the portion 154*a* covering the first fan 153 so that air in the storage chamber may pass through the cover 154.

Further, the cover 154 may have a structure that may be fixed to the rear wall 111*a* in FIG. 1 of the storage chamber. For example, in FIG. 2, the cover 154 has a portion 154*c* extending from both sides of the portion 154*a* covering the first fan 153, and a screw fastener 154*e* through which a screw may be inserted in the extended portion 154*c*. In addition, since a screw 159*c* is inserted into a portion covering the first fan 153, the cover 154 may be further fixed to the rear wall by the screw 159*c*. Holes 154*b* and 154*d* through which air may pass may be formed in the portion 154*a* covering the first fan 153 and the extended portion 154*c*.

The second heat sink 155 is arranged to be in contact with the heat dissipation portion 151*b* of the thermoelectric element 151. The second heat sink 155 is configured to exchange heat with the second region. The second region corresponds to a space between the outer case (112 in FIG. 1) and the heat dissipation cover or corresponds to the outer space of the refrigerator (100 in FIG. 1). The object to be heat-exchanged by the second heat sink 155 is air outside the outer case.

The second fan 156 is installed to face the second heat sink 155 and generates wind to accelerate heat exchange of the second heat sink 155. Promoting heat exchange of the second heat sink 155 by the second fan 156 is the same as promoting heat exchange of the first heat sink 152 by the first fan 153.

The first fan 153 and the second fan 156 may be formed as axial flow fans. The axial flow fan corresponds to a kind of fan and is formed to generate wind along a rotation axis direction of the fan. Since the first fan 153 is disposed to face the first heat sink 152 and the second fan 156 is disposed to face the second heat sink 155, the first fan 153 and the second fan 156 may be axial flow fans that blow air toward the heat sinks 152 and 155, respectively. This is because the wind generated by the first fan 153 may be directly supplied to the first heat sink 152 and the wind generated by the second fan 156 may be supplied directly to the second heat sink 155.

In some implementations, the second fan 156 may include a shroud 156*c*. The shroud 156*c* is configured to guide wind. For example, the shroud 156*c* may be configured to enclose the vanes 156*b* at a location spaced from the vanes 156*b* as shown in FIG. 2. Further, a screw coupling hole 156*d* for fixing the second fan 156 may be formed on the shroud 156*c*.

The first heat sink 152 and the first fan 153 correspond to a heat absorption side of the thermoelectric element module 150. The second heat sink 155 and the second fan 156 correspond to a heat generation side of the thermoelectric element module 150.

At least one of the first heat sink 152 and the second heat sink 155 includes a bases 152*a* and 155*a* and fins 152*b* and 155*b*, respectively. Hereinafter, it is assumed that both the first heat sink 152 and the second heat sink 155 include the bases 152*a* and 155*a* and the fins 152*b* and 155*b*.

The bases 152*a* and 155*a* are in surface contact with the thermoelectric element 151. The base 152*a* of the first heat sink 152 is in surface contact with the heat absorption portion 151*a* of the thermoelectric element 151 and the base 155*a* of the second heat sink 155 is in contact with the heat dissipation portion 151*b* of the thermoelectric element 151.

It is ideal that the bases 152*a* and 155*a* and the thermoelectric element 151 are in surface contact with each other because thermal conductivity increases as a heat transfer area increases. Also, a heat conductor (thermal grease or a thermal compound) may be used to fill a fine gap between the bases 152*a* and 155*a* and the thermoelectric element 151 to increase thermal conductivity.

The fins 152*b* and 155*b* protrude from the bases 152*a* and 155*a* to exchange heat with air in the first region or with air in the second region. Since the first region corresponds to the storage chamber (120 in FIG. 1) and the second region corresponds to the outside of the refrigerator (100 in FIG. 1), the fins 152*b* of the first heat sink 152 are configured o exchange heat with the air of the storage chamber (120 in FIG. 1) and the fins 155*b* of the second heat sink 155 are configured to exchange heat with the outside air of the refrigerator (100 of FIG. 1).

The fins 152*b* and 155*b* are disposed to be spaced apart from each other. This is because a heat exchange area may increase as the fins 152*b* and 155*b* are spaced apart from each other. If the fins 152*b* and 155*b* adjoin, there is no heat exchange area between the fins 152*b* and 155*b*, but since the fins 152*b* and 155*b* are spaced art from each other, a heat exchange area may be present between the fins 152*b* and 155*b*. As the heat transfer area increases, thermal conductivity increases. Therefore, in order to improve heat transfer performance of the heat sink, the area of the fins exposed in the first region and the second region may be increased.

In order to implement a sufficient cooling effect of the first heat sink 152 corresponding to the heat absorption side, thermal conductivity of the second heat sink 155 corresponding to the heat generation side may be larger than that of the first heat sink 152. This is because heat absorption may be sufficiently made in the heat absorption portion 151*a* when heat dissipation is quickly made in the heat dissipation portion 151*b* of the thermoelectric element 151. This is because the thermoelectric element 151 is not simply a heat conductor but an element in which heat absorption is made at one side and heat dissipation is made at the other side as a voltage is applied. Therefore, sufficient cooling may be implemented at the heat absorption portion 151*a* when stronger heat dissipation may be performed at the heat dissipation portion 151*b* of the thermoelectric element 151.

In consideration of this, when heat absorption is made in the first heat sink 152 and heat dissipation is made in the second heat sink 155, a heat exchange area of the second heat sink 155 may be larger than a heat exchange area of the first heat sink 152. Assuming that the entire heat exchange area of the first heat sink 152 is used for heat exchange, the heat exchange area of the second heat sink 155 may be, for example, three times or more of the heat exchange area of the first heat sink 152.

This principle is equally applied to the first fan 153 and the second fan 156 as well. In order to implement a sufficient cooling effect on the heat absorption side, an air volume and an air velocity formed by the second fan 156 may be larger than an air volume and an air velocity formed by the first fan 153.

The second heat sink 155 may have a larger heat exchange area than the first heat sink 152. The areas of the base 155*a* and the fins 155*b* of the second heat sink 155 may be larger than the areas of the base 152*a* and the fins 152*b* of the first heat sink 152. Further, the second heat sink 155 may be provided with a heat pipe 155*c* to rapidly distribute heat transferred to the base 155*a* of the second heat sink 155 to the fins.

The heat pipe 155*c* is configured to receive a heat transfer fluid therein, and one end of the heat pipe 155*c* passes through the base 155*a* and the other end passes through the fins 155*b*. The heat pipe 155*c* is a device that transfers heat from the base 155*a* to the fins 155*b* through evaporation of the heat transfer fluid accommodated therein. Without the heat pipe 155*c*, heat exchange may be concentrated only at adjacent fins 155*b* of base 155*a*. This is because heat is not sufficiently distributed to the fins 155*b* that are far from the base 155*a*.

However, as the heat pipe 155*c* is present, heat exchange may be made at all the fins 155*b* of the second heat sink 155. This is because the heat of the base 155*a* may be evenly distributed to the fins 155*b* disposed relatively far from the base 155*a*.

The base 155*a* of the second heat sink 155 may be formed as two layers 155*al* and 155*a*2 to house the heat pipe 155*c*. The first layer 155*al* of the base 155*a* surrounds one side of the heat pipe 155*c* and the second layer 155*a*2 surrounds the other side of the heat pipe 155*c*. The two layers 155*a*1 and 155*a*2 may be arranged to face each other.

The first layer 155*a*1 is disposed to be in contact with the heat dissipation portion 151*b* of the thermoelectric element 151 and may have a size which is the same as or similar to that of the thermoelectric element 151. The second layer 155*a*2 is connected to the fins 155*b*, and the fins 155*b* protrude from the second layer 155*a*2. The second layer 155*a*2 may have a larger size than the first layer 155*a*1. One end of the heat pipe 155*c* is disposed between the first layer 155*a*1 and the second layer 155*a*2.

The insulating member 157 is installed between the first heat sink 152 and the second heat sink 155. The insulating member 157 is formed to surround the edge of the thermoelectric element 151. For example, as shown in FIG. 2, a hole 157*a* may be formed in the insulating member 157, and a thermoelectric element 151 may be disposed in the hole 157*a*.

As described above, the thermoelectric element module 150 is a device which implements cooling of the storage chamber 120 in FIG. 1 through heat absorption and heat dissipation at one side and the other side of the thermoelectric element 151, and is not a simple heat conductor. Heat of the first heat sink 152 may not be directly transmitted to the second heat sink 155. If a temperature difference between the first heat sink 152 and the second heat sink 155 is reduced due to direct heat transfer, performance of the thermoelectric element 151 may be deteriorated. In order to prevent or reduce such a phenomenon, the insulating member 157 is configured to block direct heat transfer between the first heat sink 152 and the second heat sink 155.

A fastening plate 158 is disposed between the first heat sink 152 and the insulating member 157 or between the second heat sink 155 and the insulating member 157. The fastening plate 158 is for fixing the first heat sink 152 and the second heat sink 155. The first heat sink 152 and the second heat sink 155 may be screwed to the fastening plate 158.

The fastening plate 158 may be formed to surround the edge of the thermoelectric element 151 together with the insulating member 157. The fastening plate 158 has a hole 158*a* corresponding to the thermoelectric element 151 like the insulating member 157 and the thermoelectric element 151 may be disposed in the hole 158*a*. However, the fastening plate 158 is not an essential component of the thermoelectric element module 150, and may be replaced with any other component capable of fixing the first heat sink 152 and the second heat sink 155.

The fastening plate 158 may be formed with a plurality of screw fastening holes 158*b* and 158*c* for fixing the first and second heat sinks 152 and 155. The first heat sink 152 and the insulating member 157 are formed with screw fastening holes 152*c* and 157*b* corresponding to the fastening plate 158 and a screw 159*a* is sequentially fastened to the three screw fastening holes 152*c*, 157*b*, and 158*b* to fix the first heat sink 152 to the fastening plate 158. The second heat sink 155 is also provided with a screw fastening hole 155*d* corresponding to the fastening plate 158 and a screw 159*b* may be sequentially inserted into the two screw fastening holes 158*c* and 155*d* to fix the second heat sink 155 to the fastening plate 158.

The fastening plate 158 may be provided with a recess portion 158*d* adapted to accommodate one side of the heat pipe 155*c*. The recess portion 158*d* may be formed corresponding to the heat pipe 155*c* and may be partially surround it. Even though the second heat sink 155 has the heat pipe 155*c*, since the fastening plate 158 has the recess portion 158*d*, the second heat sink 155 may be brought into close contact with the fastening plate 158 and the entire thickness of the thermoelectric element module 150 may be reduced to be thinner.

At least one of the first fan 153 and the second fan 156 described above includes hubs 153*a* and 156*a* and vanes 153*b* and 156*b*. Hubs 153*a* and 156*a* are coupled to a rotation center shaft. The vanes 153*b* and 156*b* are radially installed around the hubs 153*a* and 156*a*.

The axial flow fans 153 and 156 may be different from a centrifugal fan. For instance, the axial flow fans 153 and 156 are configured to generate wind in the direction of a rotating shaft, and air flows in and out along the direction in which the rotating shafts of the axial flow fans 153 and 156 extend. By contrast, the centrifugal fan may generate wind in a centrifugal direction (or in a circumferential direction), and air flows in the direction of a rotating shaft of the centrifugal fan and flows out in the centrifugal direction.

Figure 3:
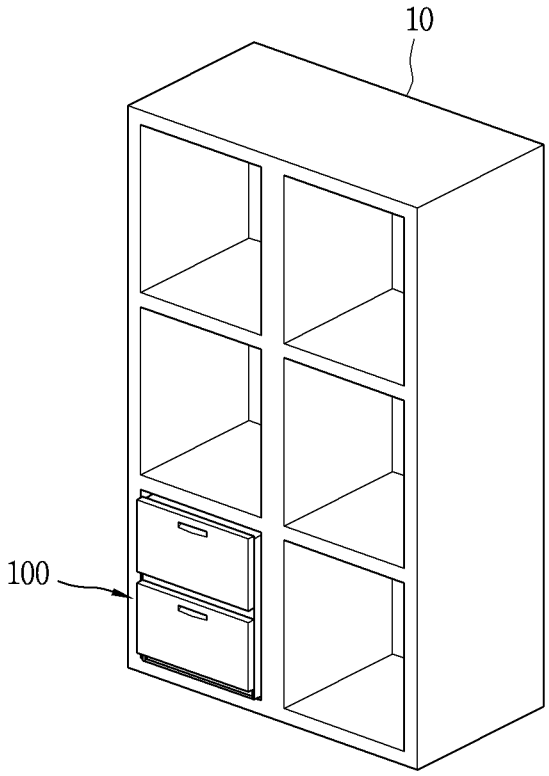
FIG. 3 is a conceptual diagram of an example of a built-in refrigerator including a thermoelectric element module.

FIG. 3 is a conceptual diagram of an example of a built-in refrigerator 100 having a thermoelectric element module.

The built-in refrigerator 100 refers to a refrigerator 100 embedded in an inner wall of a building or furniture. Since the built-in refrigerator 100 is designed together with a building or furniture, the built-in refrigerator 100 may utilize space efficiently. On the other hand, the built-in refrigerator 100 has a disadvantage that it is difficult to repair or replace.

The refrigerator 100 of the present disclosure includes a thermoelectric element module, and the thermoelectric element module has a very small size as compared with the refrigeration cycle device. Therefore, the refrigerator 100 having the thermoelectric element module is suitable to be implemented by the built-in refrigerator 100. In FIG. 3, the refrigerator 100 is embedded in the furniture.

The built-in refrigerator 100 embedded in a wall or furniture is blocked by a shielding film on all sides. In FIG. 3, the refrigerator 100 is embedded in one of the storage chambers, and the refrigerator 100 is blocked by a partition of the storage chamber. The partition wall of the storage space corresponds to the shielding film.

If the refrigerator 100 is surrounded by the shielding film, the refrigerator 100 naturally has a structure that is vulnerable to heat dissipation. If a separate cooling system is not provided, the heat dissipation side of the thermoelectric element module is cooled by natural convection of air. However, if an air flow to be supplied to the thermoelectric element module is blocked by the shielding film, the heat dissipation side of the thermoelectric element module is not sufficiently dissipated and cooling performance of the thermoelectric element module is also lowered.

The present disclosure addresses these and other problems, and a heat dissipation structure of the present disclosure will be described below.

Figure 4:
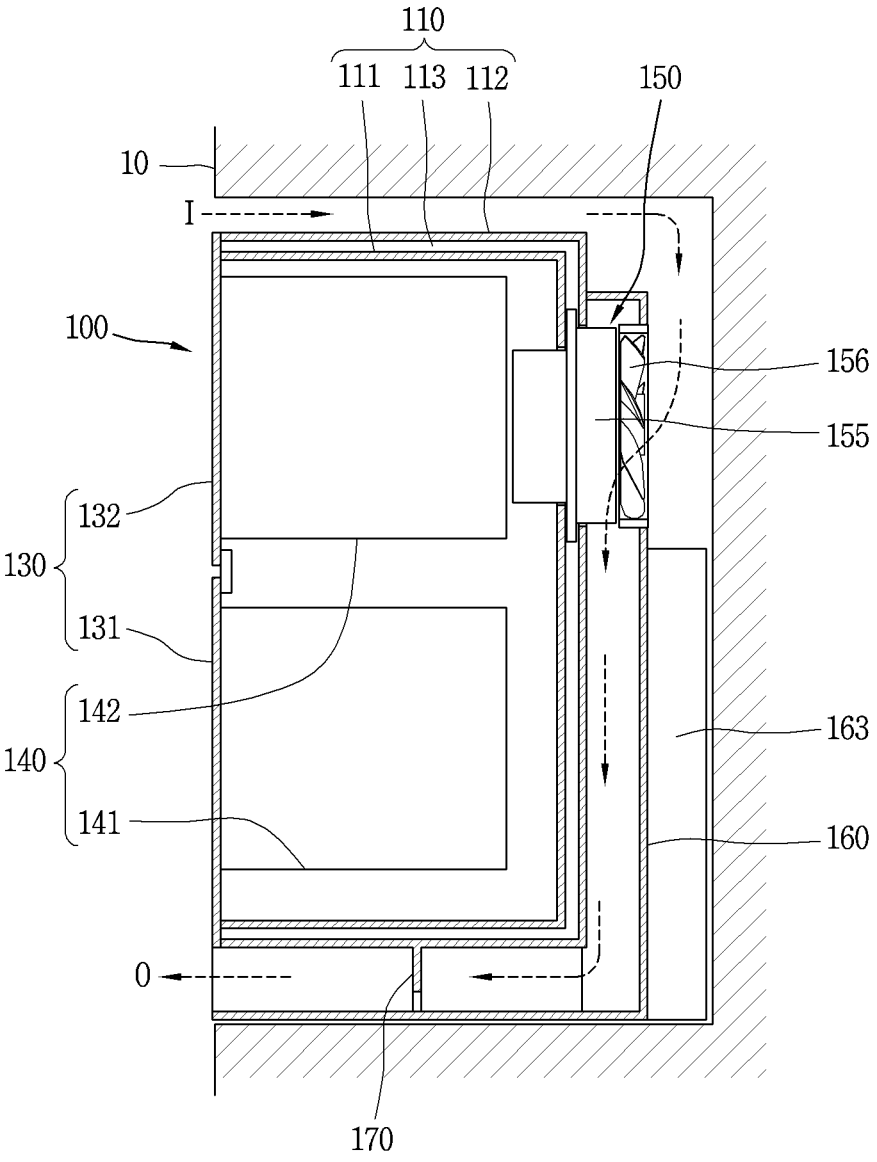
FIG. 4 is a cross-sectional view for explaining an example of a heat dissipation structure of a refrigerator.
Figure 5:
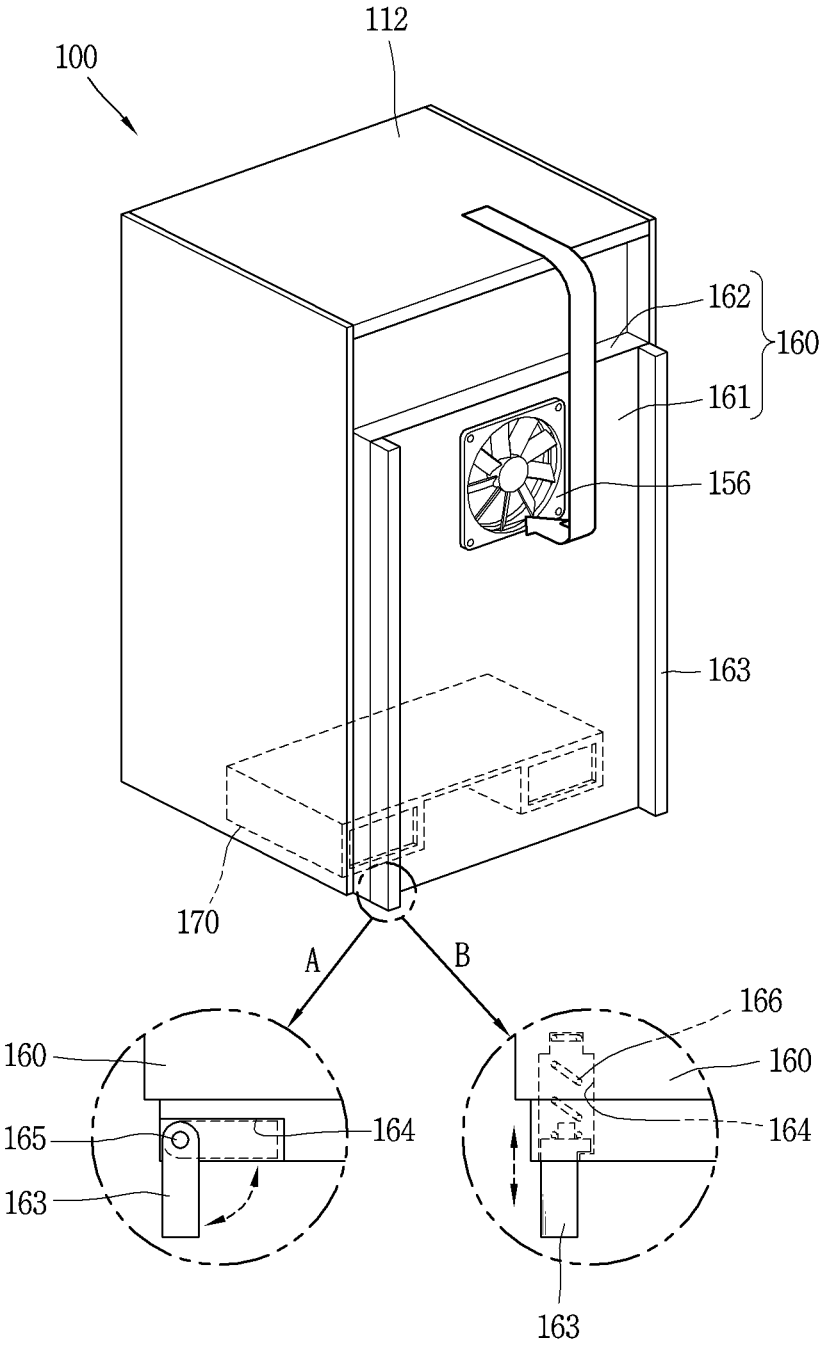
FIGS. 5 to 7 are conceptual diagrams illustrating an example of a heat dissipation structure of a refrigerator.
Figure 6:
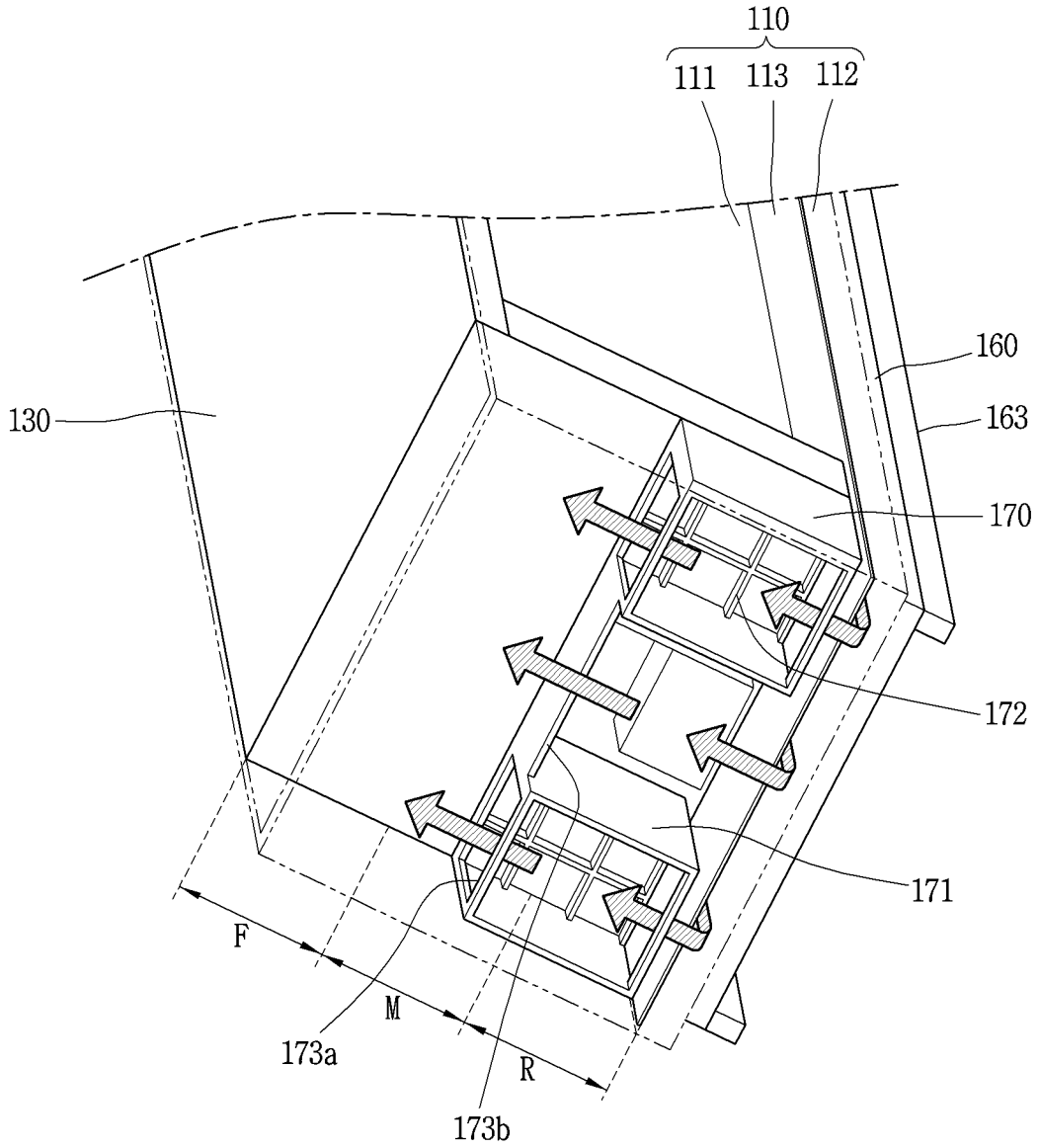
Figure 7:
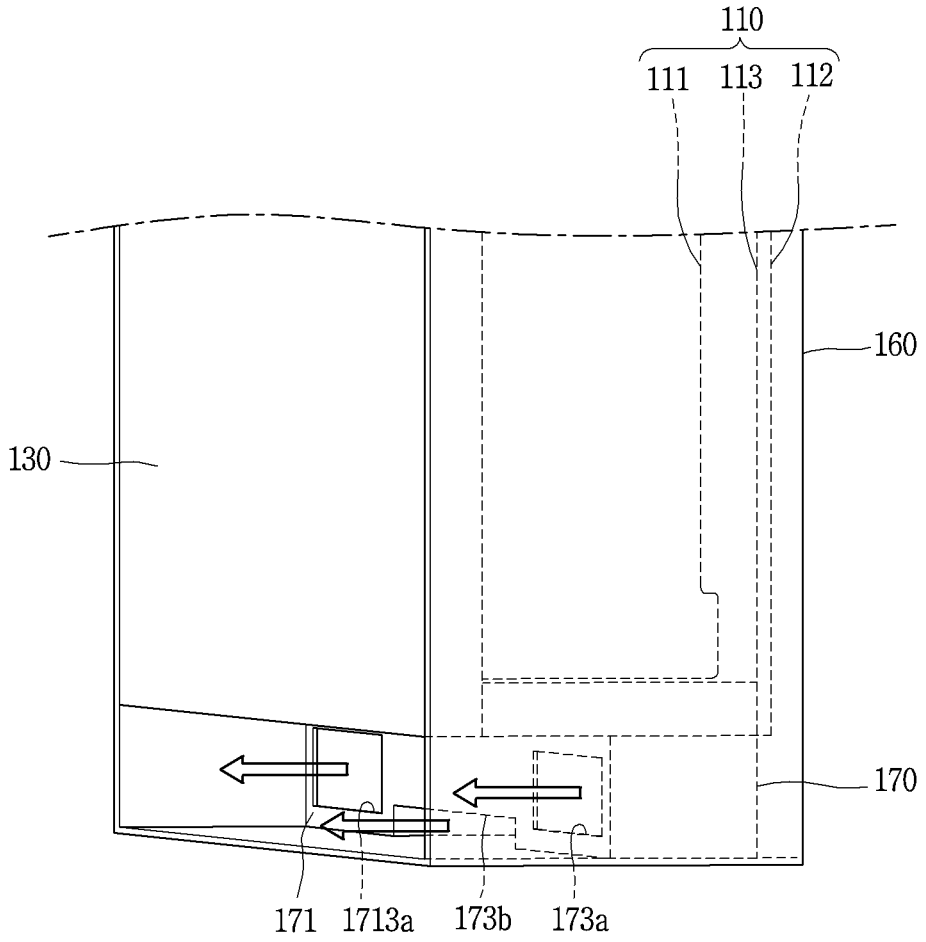

FIG. 4 is a cross-sectional view for explaining an example of a heat dissipation structure of the refrigerator 100. FIGS. 5 to 7 are conceptual diagrams illustrating an example of a heat dissipation structure of the refrigerator 100.

The refrigerator 100 of the present disclosure is formed to suction air to the rear surface and discharge air to the front of the cabinet 110 through a lower side of the cabinet 110. In FIG. 4, I indicates air drawn between the shielding film of the furniture 10 and the cabinet 110, and O indicates air discharged to the lower side of the cabinet 110.

The second fan 156 suctions air outside the heat dissipation cover 160 to the inside of the heat dissipation cover 160 so as to accelerate heat exchange of the second heat sink 155. Since the second fan 156 is installed to be visually exposed to the outside through the heat dissipation cover 160, when the second fan 156 rotates, the air is suctioned into the heat dissipation cover 160. The air suctioned into the heat dissipation cover 160 is heat-exchanged with the second heat sink 155 and receives heat from the second heat sink 155. Thus, heat dissipation of the second heat sink 155 is performed.

The second fan 156 is disposed above the center of the heat dissipation cover 160 to suction air through an upper portion of the heat dissipation cover 160. For example, in FIG. 4, when the heat dissipation cover 160 is divided into a lower portion and an upper portion with respect to the center of the heat dissipation cover 160, the lower portion of the heat dissipation cover 160 is disposed at a height corresponding to the lower drawer 142 among the two drawers 141 and 142. Also, the upper portion of the heat dissipation cover 160 is disposed at a height corresponding to the upper drawer 142. Since the second fan 156 is disposed above the center of the heat dissipation cover 160, the second fan 156 is disposed at a position facing the upper drawer 142. Accordingly, air is suctioned into the heat dissipation cover 160 through the upper portion of the heat dissipation cover 160.

The heat dissipation cover 160 is formed to guide air suctioned by the second fan 156 in the top-down direction. The heat dissipation cover 160 is formed to cover the upper and left and right sides of the cover opening where the second fan 156 is installed. Accordingly, the air suctioned into the inside of the heat dissipation cover 160 by the second fan 156 is naturally guided in the top-down direction.

Referring to FIG. 5, the heat dissipation cover 160 includes a main plate 161 and an edge portion 162.

The main plate 161 is disposed to be spaced apart from the rear surface of the outer case 112. Accordingly, a flow path for guiding the flow of air is formed between the rear surface of the outer case 112 and the main plate 161. The main plate 161 has an opening at a position facing the second fan 156. The second fan 156 is installed to be visually exposed to the outside of the heat dissipation cover 160 through the cover opening.

The edge portion 162 protrudes from the rim of the main plate 161 toward the outer case 112 and is coupled to the outer case 112. The edge portion 162 is formed at the upper end, the left end, and the right end of the main plate 161. The edge portion 162 serves to shield a flow path through which air flows in or is leaked out, and thus, air flowing into the heat dissipation cover 160 by the second fan 156 is guided in the top-down direction along a flow path between the rear surface of the outer case 112 and main plate 161.

Referring to FIGS. 4 to 7, the support 170 separates the cabinet 110 from the floor so that air suctioned through the second fan 156 and guided by the heat dissipation cover 160 is discharged to the front of the cabinet 110 through a lower side of the cabinet 110. Here, the floor may refer to a floor where the refrigerator 100 is installed. For example, if the refrigerator 100 is embedded in furniture, the floor may refer to a partition of the furniture. As the cabinet 110 is separated from the floor by the supporter 170, a flow path through which air may be discharged is formed between the cabinet 110 and the floor. Accordingly, the air may be discharged to the front of the cabinet 110 through the lower side of the cabinet 110.

The support 170 includes a bridge portion 171, a rib 172, and discharge ports 173*a* and 173*b*. A detailed structure of the support 170 is shown in FIG. 6.

The bridge portion 171 separates the cabinet 110 from the floor and is formed to support the cabinet 110. If portions where an upper end is in contact with a bottom surface of the cabinet 110 along the vertical direction and a lower end is in contact with the floor at the supporter 170, all of the portions correspond to the bridge portion 171.

The rib 172 is connected to two different portions of the bridge portion 171 to reinforce strength of the support 170. The rib 172 may have a lattice-like structure.

The discharge ports 173*a* and 173*b* are formed at the bridge portion 171 so as to discharge air from the lower side of the cabinet 110 to the front side of the cabinet 110. The discharge ports 173*a* and 173*b* may be divided into a main discharge port 173*a* and a sub-discharge port 173*b* according to their sizes. The discharge port 173*a* having a large size corresponds to the main discharge port 173*a* and the discharge port 173*b* having a small size corresponds to the sub-discharge port 173*b*.

Air may be discharged through the discharge ports 173*a* and 173*b* formed at the bridge portion 171 while the bridge portion 171 supports the cabinet 110. The rib 172 is formed so as to compensate for a degradation of strength of the support 170 due to the discharge ports 173*a* and 173*b*.

As described above, in the present disclosure, the suction port of the air and the discharge ports 173*a* and 173*b* are distant from each other. Here, the suction port indicates an opening where the second fan 156 is installed.

Air is suctioned from the upper portion of the heat dissipation cover 160 and air is discharged through the lower side of the cabinet 110 so that the air suction port and the discharge ports 173*a* and 173*b* are spaced apart from each other at the front and rear of the refrigerator 100. Also, since the air is suctioned in through the heat dissipation cover 160 disposed behind the cabinet 110 and the air is discharged to the front of the cabinet 110, the air suction port and the discharge ports 173*a* and 173*b* are spaced apart from each other in a vertical direction of the refrigerator 100.

Since the air suction port and the discharge ports 173*a* and 173*b* are spaced apart from each other, according to the structure of the present disclosure, it is possible to prevent the air discharged from the refrigerator 100 from being suctioned back into the suction port again. In addition, when air is discharged through the lower side of the cabinet 110, hot air may be prevented from being transmitted to the user's face.

Such a heat dissipating structure is suitable for the built-in refrigerator 100. If the air introduced through the upper side of the cabinet 110 is suctioned to the inside of the heat dissipation cover 160 and then discharged to the lower side of the cabinet 110 as shown in FIG. 4, although the left and right side surfaces of the cabinet 110 are completely covered by the shielding film, there is no problem with air flow.

In order to suction air, the main plate 161 of the heat dissipation cover 160 may be spaced apart from the shielding film of furniture or the like. This is because if the main plate 161 is in close contact with the shielding film, air cannot be suctioned into the heat dissipation cover 160. In order to separate the main plate 161 from the shielding film, the refrigerator 100 includes a stopper 163.

The stopper 163 protrudes from the heat dissipation cover 160 toward the shielding film disposed on the rear side of the refrigerator 100 so as to separate the heat dissipation cover 160 from the shielding film disposed on the rear side of the refrigerator 100. Since the heat dissipation cover 160 is separated from the shielding film by the stopper 163, air may be suctioned through a space between the heat dissipation cover 160 and the shielding film.

Referring to FIG. 5, the heat dissipation cover 160 has an accommodation portion 164 formed to accommodate the stopper 163 therein. Referring to A, the heat dissipation cover 160 has a hinge 165, and the stopper 163 is connected to the hinge 165. Therefore, the stopper 163 may be inserted into the accommodation portion 164 or drawn out from the accommodation portion 164 through rotation. Referring to B, an elastic member 166 may be coupled to the stopper 163 to support the stopper 163. The stopper 163 may be inserted into the accommodation portion 164 or drawn out from the accommodation portion 164 through linear movement. The refrigerator 100 may have a structure of at least one of A and B.

It is also considered that I and O shown in FIG. 4 are interchanged. In this case, the second fan 156 may be rotated in the opposite direction. Air is suctioned into the lower side of the cabinet 110 and air is blown to the rear side of the heat dissipation cover 160.

Referring to FIG. 6, a lower surface of the cabinet 110 may be divided into a front portion F, a rear portion R, and a middle portion M between the front portion F and the rear portion R, depending on the position. The support 170 may be formed to support the middle portion M and the rear portion R so that an empty space is formed below the front portion F.

This structure is to prevent visual exposure of the audio-visual module installed in the support 170. The audio-visual module will be described with reference to FIGS. 8A to 8C showing a structure of the support 170.

Figure 8A:
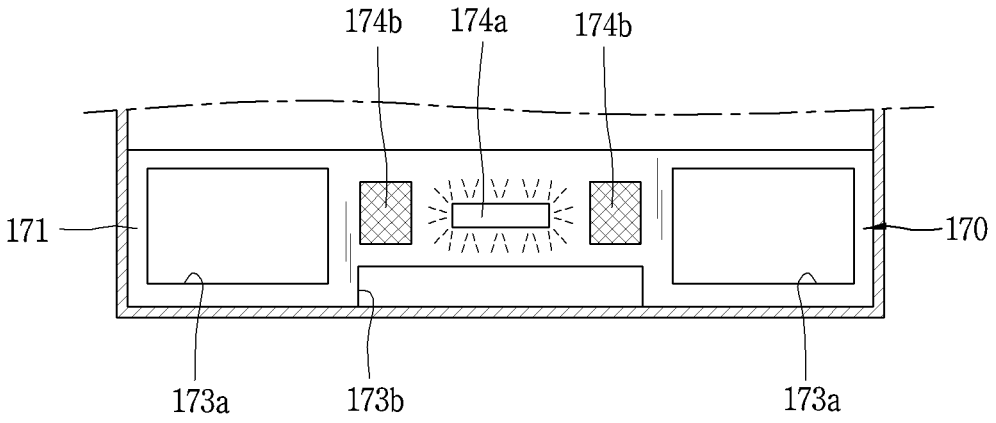
FIG. 8A is a front view showing an example of a support for supporting a cabinet.

FIG. 8A is a front view showing an example of a support 170 supporting a cabinet. FIG. 8B is a front view showing another example of a support 270 supporting a cabinet. FIG. 8C is a front view showing another example of a support 370 supporting a cabinet.

Audio-visual modules 174*a* and 174*b*, 274*a* and 274*b*, and 374*a* and 374*b* formed to provide at least one of light and sound is mounted on a front surface of the support 170, 270, and 370. The audio-visual modules 174*a* and 174*b*, 274*a* and 274*b*, and 374*a* and 374*b* include light emitting elements 174*a*, 274*a*, and 374*a* providing light or include speakers 174*b*, 274*b*, and 374*b* providing a sound. Discharge ports 173*a* and 173*b*, 273*a* and 273*b*, or 373*a* and 373*b* are formed on at least one of one side or the other side of the audio-visual modules 174*a* and 174*b*, 274*a* and 274*b*, or 374*a* and 374*b*.

Figure 8B:
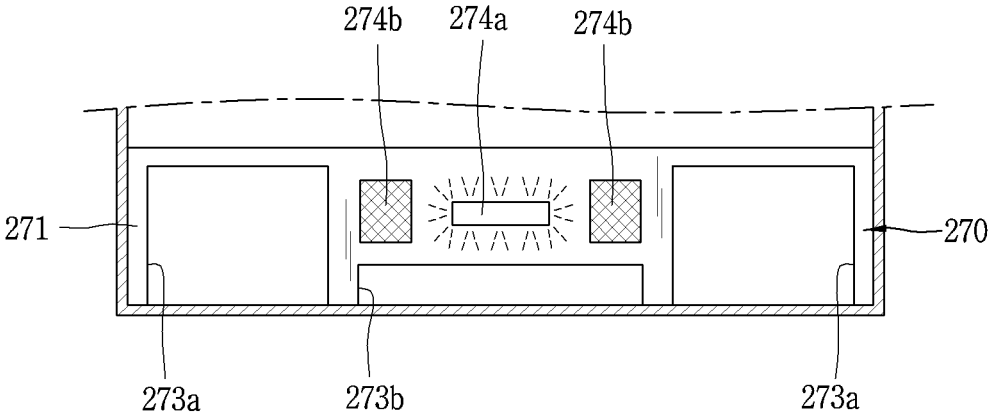
FIG. 8B is a front view showing another example of a support for supporting the cabinet.
Figure 8C:
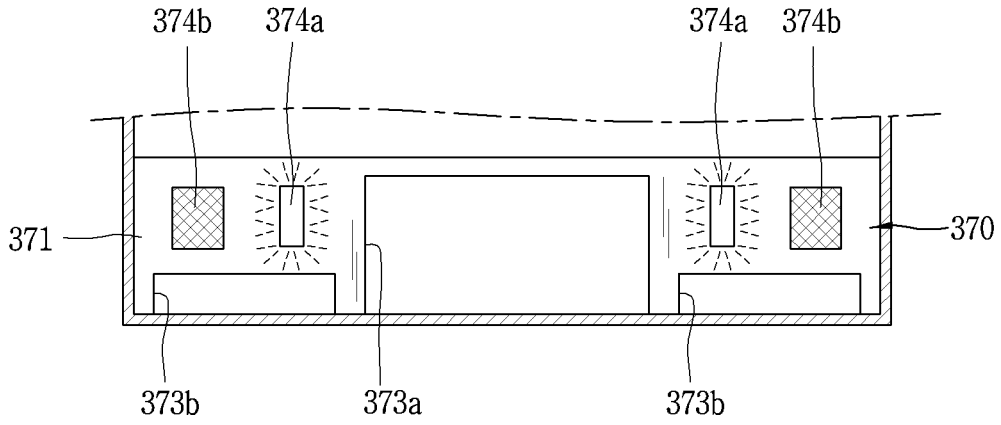
FIG. 8C is a front view showing another example of a support for supporting the cabinet.

Referring to FIGS. 8A and 8B, main discharge ports 173*a* and 273*a* are formed on both sides of the light emitting elements 174*a* and 274*a* and the speakers 174*b* and 274*b*. Compared with 8A and 8B, it can be seen that the main discharge port 273*a* shown in FIG. 8B is completely opened to the bottom and has an expanded size larger than the main discharge port 173*a* shown in FIG. 8A. Sub-discharge ports 173*b* and 273*b* having a size smaller than the main discharge ports 173*a* and 273*a* are formed below the light emitting elements 174*a* and 274*a* and the speakers 174*b* and 274*b*.

FIG. 8C is a front view showing another example of a support table 170 for supporting the cabinet 110.

Two light emitting elements 374*a* and speakers 374*b* are provided. The two light emitting elements 374*a* are arranged to be spaced apart from each other, and the two speakers 374*b* are also arranged to be spaced apart from each other. The main discharge port 373*a* is formed between the two light emitting elements 374*a* and between the two speakers 374*b*. The sub-discharge port 373*b* has a size smaller than the main discharge port 373*a* and is formed above or below the light emitting elements 374*a* and the speaker 374*b*. In FIG. 8C, a sub-discharge port 373*b* is provided below the light emitting element 374*a* and the speaker 374*b*.

Since the supports 170, 270 and 370 support the middle portion (M in FIG. 6) and the rear portion (R in FIG. 6) of the lower surface of the cabinet (110 in FIG. 6), the front surface of the supports 170, 270, and 370 is disposed below the middle portion. Therefore, the audio-visual modules 174*a* and 174*b*, 274*a* and 274*b*, and 374*a* and 374*b* installed on the front surface of the support 170 are visually covered to the user. However, light or sound provided from the audio-visual modules 174*a* and 174*b*, 274*a* and 274*b*, and 374*a* and 374*b* may be transmitted to the user through a lower side of the cabinet 110.

Since the built-in refrigerator 100 is surrounded by the shielding film, it may be difficult to provide light or sound to the user. However, if light or sound is transmitted to the user through the lower surface of the cabinet 110, there is an advantage that it is not limited by the shielding structure.

Hereinafter, another implementation of the present disclosure will be described.

Figure 9:
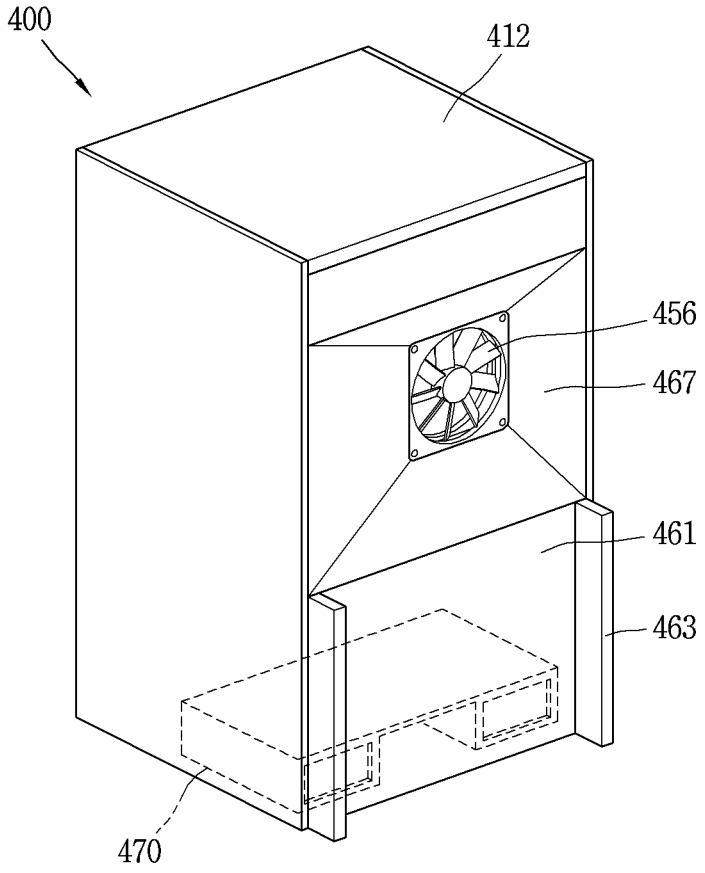
FIG. 9 is a conceptual view showing another example of a refrigerator including a thermoelectric element module.

FIG. 9 is a conceptual view showing another example of a refrigerator 400 having a thermoelectric element module.

A main plate 461 has an inclined portion 467 around a cover opening where a second fan 456 is disposed. The inclined portion 467 may define a slope in a direction away from a rear surface of an outer case 412 as it approaches the cover opening. For example, a horizontal distance between the rear surface of the outer case 412 and the inclined portion 467 may increase from an outer edge of the inclined portion 467 toward a periphery of the cover opening. The inclined portion 467 may increase a suction flow rate and a flow rate of air suctioned into the second fan 456 and guide a flow of the air so that the air is suctioned into the second fan 456 more smoothly.

When the structure of FIG. 9 is compared with the structure described above in FIG. 5, the refrigerator 400 of the implementation shown in FIG. 9 has experimentally larger cooling performance. This is because a temperature of the heat absorption portion, which may be obtained from the thermoelectric element module, may be further lowered due to smooth heat dissipation.

In contrast to FIG. 5, because the inclined portion 467 is close to the cover opening, it may form a slope away from the rear surface of an outer case 412. In this case, a flow of the air suctioned into the second fan 456 is naturally secure, so that the refrigerator 400 does not need to have a stopper 463.

Figure 10:
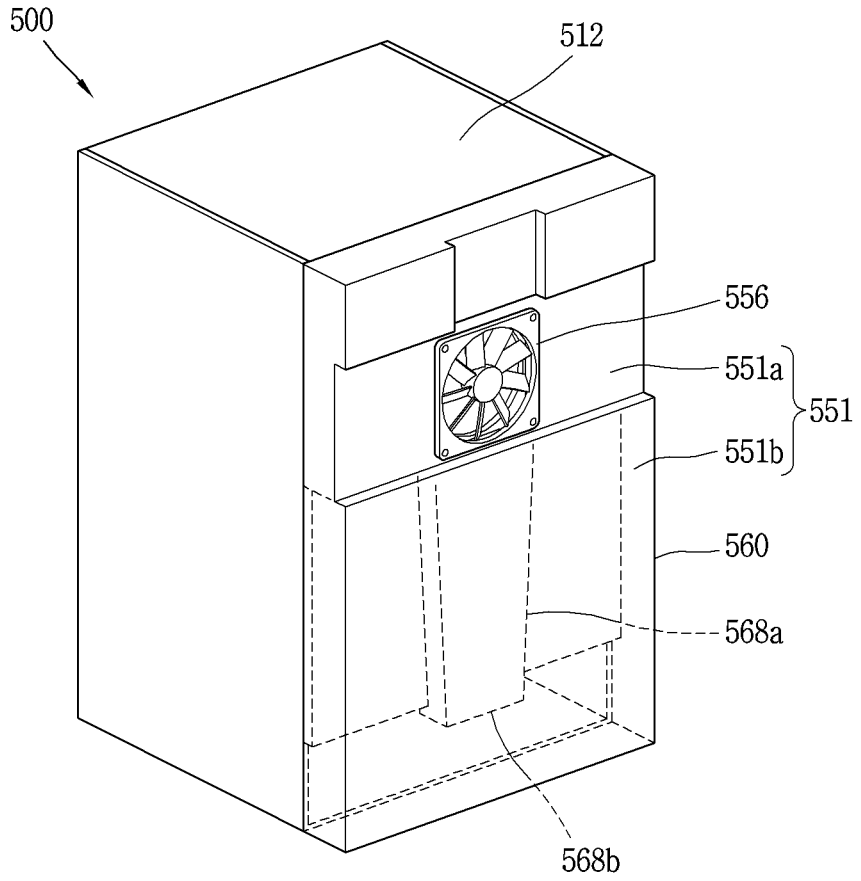
FIG. 10 is a conceptual view showing another example of a refrigerator including a thermoelectric element module.
Figure 11:
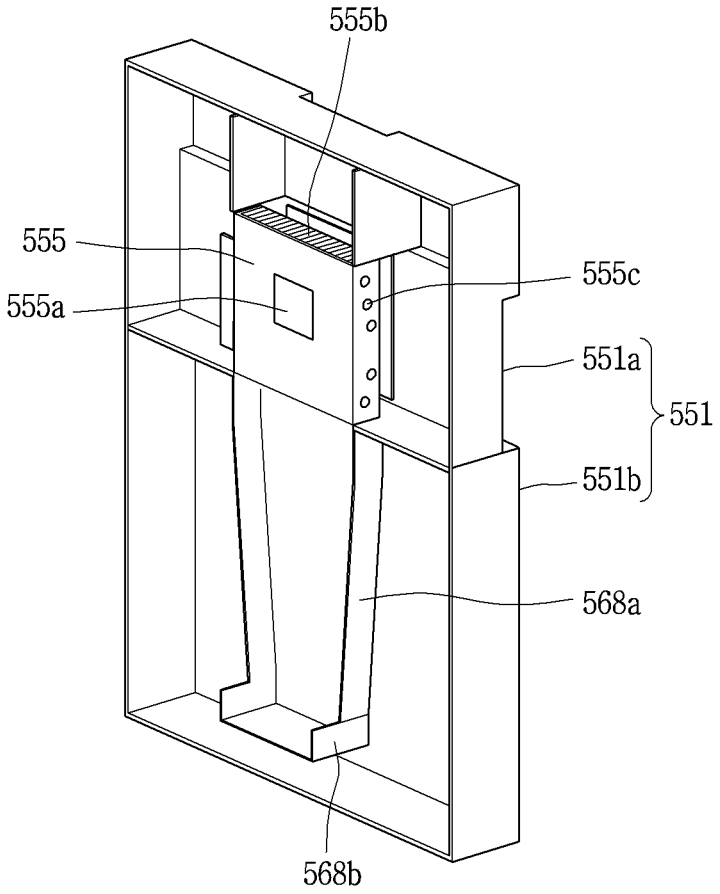
FIG. 11 is a perspective view showing an example of an inside of a heat dissipation cover shown in FIG. 10.

FIG. 10 is a conceptual view showing still another example of a refrigerator 500 having a thermoelectric element module. FIG. 11 is a conceptual view of an inner side of a heat dissipation cover 560 shown in FIG. 10.

The heat dissipation cover 560 has guide portions 568*a* and 568*b* for guiding a flow of air.

The first guide portion 568*a* protrudes from the main plate 561 toward the outer case 512 below the cover opening where the second fan 556 is installed. The first guide portion 568*a* extends along a longitudinal direction to guide the air suctioned by the second fan 556 in the top-down direction.

The second guide portion 568*b* protrudes from a lower end of the first guide portion 568*a* to between the cabinet 510 and the floor to guide the air guided by the first guide portion 568*a* to be discharged toward the front of the cabinet 510 through the lower side of the cabinet 510. The second guide portion 568*b* extends forward.

The air guided in the top-down by the first guide portion 568*a* is again guided to the front of the cabinet 510 by the second guide portion 568*b*. Also, the air is discharged to the front of the cabinet 510 through the discharge port of the support 570.

In some implementations, referring to FIG. 11, a plurality of fins 555*b* provided in a second heat sink 555 extend in a vertical direction to make the air suctioned by the second fan 556 to flow from the top to the bottom, and are arranged to be spaced apart from each other in a horizontal direction. Thus, a vertical flow path is formed between the plurality of fins 555*b*. Air may be guided in the top-down direction along this flow path. This structure may be confirmed also in FIG. 1.

The main plate 551 may be divided into a first portion 551*a* and a second portion 551*b*.

The first portion 551*a* has an opening in which the second fan 556 is installed at a position facing the second fan 556.

The second portion 551*b* is disposed on one side of the first portion 551*a* and protrudes toward the shielding film further than the first portion 551*a* so as to separate the first portion 551*a* from the shielding film disposed on the rear of the refrigerator 500. Since the second portion 551*b* protrudes further than the first portion 551*a*, a flow path for suctioning air may be naturally formed between the first portion 551*a* and the shielding film. Therefore, the refrigerator 500 need not have a stopper.

Figure 12:
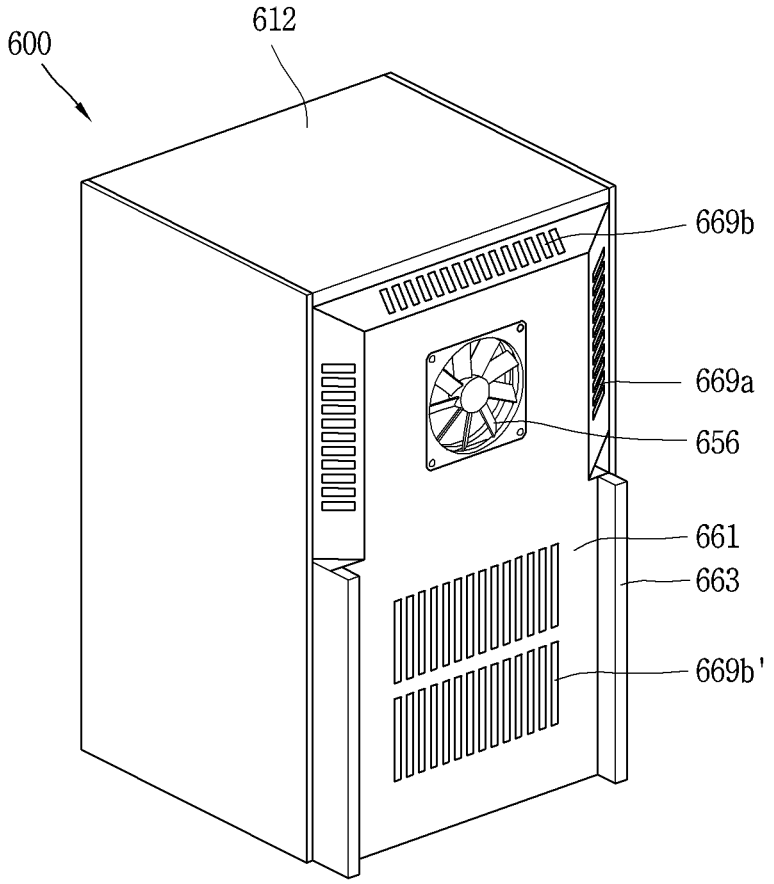
FIG. 12 is a conceptual view showing another example of a refrigerator including a thermoelectric element module.

FIG. 12 is a conceptual view showing still another example of a refrigerator 600 having a thermoelectric element module.

A heat dissipation cover 560 may additionally have at least one ventilation hole 669*a*, 669*b*, or 669*b*' around the cover opening in which the second fan 656 is installed. This structure may be suitable for a structure in which all sides of the refrigerator 600 are not shielded because there is a possibility of re-suction.

When the ventilation hole 669*a* are formed on the left and right sides of the cover opening, hot air is raised due to natural convection after being discharged through the ventilation hole, the possibility of re-suction is small. This is because the four sides of the refrigerator 600 are not shielded.

In some implementations, where ventilation holes 669*b* and 669*b*' may be defined on the left and right sides and the upper and lower sides of the cover opening, air may be discharged at a high flow rate. If the flow rate of the air to be discharged is high, the possibility of re-suction is low.

The refrigerator described above is not limited to the configuration and the method of the implementations described above, but the implementations may be configured by selectively combining all or some of the implementations so that various modifications may be made.

INDUSTRIAL APPLICABILITY

The present disclosure may be applied to industrial fields related to refrigerators.

What is claimed is:

1. A refrigerator comprising:

a cabinet comprising an inner case that defines a storage chamber, an outer case that covers the inner case, and an insulating material disposed between the inner case and the outer case;

a thermoelectric element module disposed at a rear wall of the cabinet facing the storage chamber and configured to cool the storage chamber;

a support disposed at a lower surface of the cabinet and configured to support the cabinet;

a heat dissipation cover coupled to a rear side of the outer case; and a stopper that protrudes rearward from the heat dissipation cover and defines a space between the heat dissipation cover and a shielding film disposed rearward relative to a rear side of the refrigerator, wherein the thermoelectric element module comprises:

a thermoelectric element comprising a heat absorption portion and a heat dissipation portion that face opposite directions, a first heat sink that is in contact with the heat absorption portion and that is configured to exchange heat with the storage chamber, a first fan that faces the first heat sink and that is configured to generate air flow to thereby assist heat exchange of the first heat sink, a second heat sink that is in contact with the heat dissipation portion and that is configured to exchange heat with an external region of the outer case, a second fan that is exposed to an outside of a rear surface of the heat dissipation cover, that faces the second heat sink, and that is configured to draw air from an outside of the heat dissipation cover to an inner side of the heat dissipation cover to thereby assist heat exchange of the second heat sink, and an insulating frame that surrounds an edge of the thermoelectric element and that is configured to block direct heat transfer between the first heat sink and the second heat sink, wherein the heat dissipation cover is configured to guide air from the second fan in a vertical direction, and wherein the support defines an air passage between the lower surface of the cabinet and a floor, the air passage being configured to allow air passing through the second fan to be discharged to a front side of the cabinet through a lower side of the cabinet.

2. The refrigerator of claim 1, wherein the second fan is disposed vertically above a center of the heat dissipation cover and configured to draw air through an upper portion of the heat dissipation cover.

3. The refrigerator of claim 1, wherein the heat dissipation cover comprises:

a main plate that is spaced apart from a rear surface of the outer case and that defines a flow path configured to guide flow of air with the rear surface of the outer case; and an edge portion that protrudes from an edge of the main plate toward the outer case and that is coupled to the outer case.

4. The refrigerator of claim 3, wherein the main plate defines a cover opening that faces the second fan, and wherein the second fan is exposed to the outside of the heat dissipation cover through the cover opening.

5. The refrigerator of claim 4, wherein the main plate comprises an inclined portion that is disposed at a periphery of the cover opening and that is inclined with respect to the rear surface of the outer case, and wherein a horizontal distance between the rear surface of the outer case and the inclined portion increases from an outer edge of the inclined portion toward the periphery of the cover opening.

6. The refrigerator of claim 4, wherein the heat dissipation cover further defines at least one ventilation hole arranged around the cover opening.

7. The refrigerator of claim 4, wherein the heat dissipation cover comprises:

a first guide protrusion that protrudes from the main plate toward the outer case, that is located below the cover opening in which the second fan is installed, and that extends along a longitudinal direction to guide the air drawn by the second fan in the vertical direction; and a second guide protrusion that protrudes from a lower end of the first guide protrusion and is located between the cabinet and the floor to guide the air guided by the first guide protrusion to be discharged toward the front side of the cabinet through the lower side of the cabinet.

8. The refrigerator of claim 1, wherein the second heat sink comprises:

a base that is in surface contact with the thermoelectric element; and a plurality of fins that protrude from the base toward the second fan and that are spaced apart from one another in a horizontal direction, and wherein the plurality of fins extend in the vertical direction and are configured to guide air downward from the second fan in the vertical direction toward the lower side of the cabinet.

9. The refrigerator of claim 1, wherein the second fan comprises an axial flow fan configured to generate wind along an axial direction toward the front side of the cabinet, wherein the refrigerator comprises a left surface, a right surface, and a rear surface that are covered by the shielding film.

10. The refrigerator of claim 1, wherein the heat dissipation cover has an accommodation portion configured to accommodate the stopper, the stopper being configured to be inserted into the accommodation portion or be drawn out from the accommodation portion by a rotational movement or a linear movement relative to the heat dissipation cover.

11. The refrigerator of claim 1, wherein the second fan comprises an axial flow fan configured to generate wind along an axial direction toward the front side of the cabinet, wherein the refrigerator comprises a left surface, a right surface and a rear surface that are covered by the shielding film, wherein the heat dissipation cover comprises:

a main plate that is spaced apart from a rear surface of the outer case and that defines a flow path configured to guide flow of air with the rear surface of the outer case; and an edge portion that protrudes from an edge of the main plate toward the cabinet and that is coupled to the cabinet, and wherein the main plate comprises:

a first portion that defines a cover opening that faces the second fan, and a second portion that is disposed at one side of the first portion, that protrudes rearward of the first portion, and that defines a space between the first portion and the shielding film disposed at the rear surface of the refrigerator.

12. The refrigerator of claim 1, wherein the support comprises:

a bridge portion that separates the cabinet from the floor and that supports the cabinet, the bridge portion defining a discharge port configured to discharge air from the lower side of the cabinet to the front side of the cabinet; and a rib connected to a plurality of portions of the bridge portion and configured to reinforce strength of the support.

13. The refrigerator of claim 1, wherein the lower surface of the cabinet comprises a front portion, a rear portion, and a middle portion disposed between the front portion and the rear portion, wherein the support supports the middle portion and the rear portion of the lower surface of the cabinet, and wherein the front portion of the lower surface of the cabinet is spaced apart from the floor.

14. The refrigerator of claim 13, further comprising an audio-visual module disposed at a front surface of the support, the audio-visual module including a light emitter or a speaker.

15. The refrigerator of claim 14, wherein the support defines a discharge port configured to discharge air from the lower side of the cabinet toward the front side of the cabinet, and wherein the discharge port is defined at least at one side of the audio-visual module.

16. The refrigerator of claim 15, wherein the discharge port comprises:

a main discharge port defined at both sides of the audio-visual module; and a sub-discharge port defined at a position vertically below the audio-visual module, a size of the sub-discharge port being less than a size of the main discharge port.

17. The refrigerator of claim 15, wherein the audio-visual module comprises two audio-visual modules spaced apart from each other, and wherein the discharge port comprises:

a main discharge port defined between the two audio-visual modules; and a sub-discharge port defined at a position vertically above or below the two audio-visual modules, a size of the sub-discharge port being less than a size of the main discharge port.

18. The refrigerator of claim 1, wherein a capacity of the storage chamber is less than or equal to 200 liter.

19. The refrigerator of claim 12, further comprising a drawer configured to be inserted into and withdrawn from the storage chamber through the front side of the cabinet.

20. The refrigerator of claim 19, wherein the bridge portion of the support is disposed between the front side of the cabinet and a rear end of the drawer based on the drawer being inserted into the storage chamber.

* * * * *